US005461871A

United States Patent [19]

Bracque et al.

[11] Patent Number: 5,461,871

[45] Date of Patent: Oct. 31, 1995

[54] INSTALLATION FOR THE DISTILLATION OF AIR

[75] Inventors: Gilles Bracque, Saint Leu d'Esserent; Francois Dehaine, Villemomble; Jean-Pierre Gourbier, Le Plessis Irevise; Daniel Gourdain, Lagny Sur Marne; Alain Grelaud, La Queue en Brie; Alain Guillard, Paris; Michel Mouliney, Saint Jean de Moirans, all of France

[73] Assignee: L'Air Liquide, Societe Anonyme Pour L'Etude Et L'Exploitation Des Procedes Georges Claude, Paris, France

[21] Appl. No.: 248,255

[22] Filed: May 24, 1994

[30] Foreign Application Priority Data

Jun. 3, 1993 [FR] France ..... 93 06645

[51] Int. Cl.[6] ..... F25J 3/02

[52] U.S. Cl. ..... 62/24; 62/36; 62/42; 62/44; 62/299

[58] Field of Search ..... 62/24, 36, 42, 62/299, 44

[56] References Cited

U.S. PATENT DOCUMENTS

| | | | |
|---|---|---|---|
| 3,507,322 | 4/1970 | Tetrick et al. | 62/299 |
| 4,319,900 | 3/1982 | Gram | 62/42 |
| 4,853,015 | 8/1989 | Yoshino | 62/42 |
| 4,957,523 | 9/1990 | Zarate et al. | 62/44 |

FOREIGN PATENT DOCUMENTS

| | | |
|---|---|---|
| 2108901 | 5/1972 | France . |
| WO90/08932 | 8/1980 | WIPO . |

*Primary Examiner*—Ronald C. Capossela
*Attorney, Agent, or Firm*—Young & Thompson

[57] ABSTRACT

Air distillation installation comprising: (A) an air compressor group (1) whose output is connected to an outlet coupling (11); (B) two cylinders (2A, 2B) for the purification of air by adsorption having inlet/outlet couplings (12A, 12B); (C) a first framework (13) in which are mounted: (a) the accessories downstream of the compressor such as an assembly (14, 17) for precooling air; (b) accessories of the purification cylinders, such as an assembly of valves and a regeneration gas reheater (18); and (c) the connection conduits of the mentioned accessories, with their safety members and their automatic and/or remotely controlled valves, these conduits terminating in couplings (15, 22A, 22B, 23) for connection to other portions (1, 2A, 2B, 4) of the installation, and the corresponding monitoring, control and instrumentation members (21); (D) a second framework (31) in which are mounted: (d) the principal heat exchangers (24) and the subcoolers (25); (e) the assembly of the cold accessories such as the cryogenic valves and the cryogenic pumps (26) and the expansion turbines (27); and (f) the conduits for connecting the elements mounted in the second framework, with their safety members and their automatic and/or remotely controlled valves, these conduits terminating in couplings (29, 30) for connection to other portions (3, 5) of the installation; (E) an air distillation column (5) provided with a certain number of couplings (33) for the inlet and outlet of fluids; and (F) tubes (6) for connection between the associated couplings (11–15, 12A–22A, 12B–22B, 23–29, 30–33) of the portions (A) to (E) of the installation.

16 Claims, 2 Drawing Sheets

INSTALLATION FOR THE DISTILLATION OF AIR

The present invention relates to air distillation installations.

The design of these installations is subject to requirements of different natures, such as the facility of mounting at the site and the convenience of transporting the elements of the installation to the site, the choices in this latter respect being strictly limited by the maximum road and railway clearances.

It has been proposed to preassemble in the factory all of the installation, except the air compressor group and the cylinders for the purification of air by adsorption. The work at the site is thus reduced to a minimum. However, this is possible only for small installations, and moreover is actually economical only for installations comprising a distillation column of low height, such as the HPN (high purity nitrogen) installations producing only nitrogen.

The invention has for its object to provide a flexible solution usable in practically all air distillation installations, even of large size.

To this end, according to a first embodiment, the invention has for its object an air distillation installation comprising:

(A) an air compressor group whose output is connected to an outlet connection;

(B) two cylinders for the purification of air by adsorption having inlet/outlet connections;

(C) a first framework in which are mounted: (a) the accessories downstream of the compressor such as an air precooling assembly; (b) the accessories for the purification cylinders, such as an assembly of valves and a regenerative gas reheater; and (c) the connection conduits for the recited accessories, with their security devices and their automatic and/or remotely controlled valves, these conduits terminating if desired in couplings for connection to other portions of the installation, and the corresponding monitoring, control and instrumentation members;

(D) a second framework in which are mounted: (d) the principal heat exchangers and subcoolers; (e) the assembly of cold accessories such as cryogenic valves and as the case may be cryogenic pumps and the expansion turbines; and (f) the connection conduits of the elements mounted in the second framework, with their safety members and their automatic and/or remotely controlled valves, these conduits terminating as the case may be in connections for connection to other portions of the installation, and the corresponding monitoring, control and instrumentation members, the cold parts being thermally insulated;

(E) an air distillation column provided with a certain number of connections for inlet and outlet of fluids; and (F) the connection tubing between the connections associated with parts (A) to (E) of the installation.

Each framework can particularly mount the assembly of the monitoring, control and instrumentation members in a lateral recess situated at its lower portion, the two recesses facing each other and defining a work station for the operator.

According to a second embodiment, the installation according to the invention comprises:

(A) an air compressor group whose output is connected to an outlet connection;

(B) two cylinders for the purification of air by adsorption having inlet/outlet connections;

(C) an air distillation column provided with a certain number of connections for the inlet and outlet of fluids;

(D) a framework in which are mounted all, or practically all, the other elements of the installation, with their connection conduits provided with their safety members and their automatic and/or remotely controlled valves, these conduits terminating as the case may be in connectors for connection to the other portions of the installation; and (E) tubing for connection between the connections associated with parts (A) to (D) of the installation.

The framework can in particular mount the assembly of the monitoring, control and instrumentation members in a lateral recess located at its lower portion.

Moreover, in one or the other of the two above embodiments, the following characteristics can be adopted:

a conduit for venting to the air residual gas from the column is mounted in the framework, or in at least one of the two frameworks;

all the connection tubing is straight;

the column is insulated under vacuum;

the column is a double air distillation column comprising a medium pressure column surmounted by a low pressure column;

the purification cylinders are mounted in the framework, or in at least one of the two frameworks;

the air compressor group is mounted in the framework, or in said first framework.

Examples of embodiment of the invention will now be described with respect to the accompanying drawings, in which.

Figure 1:
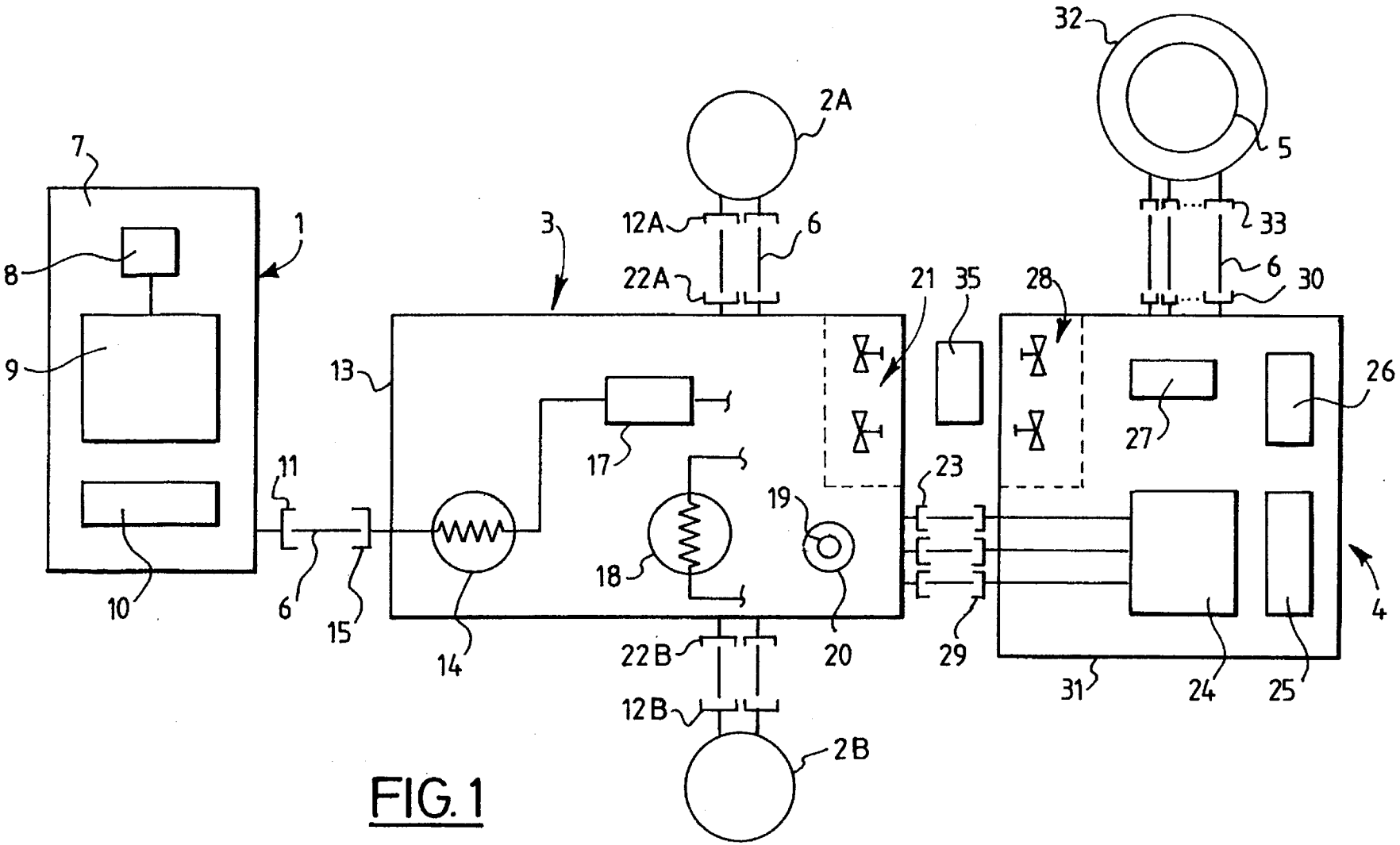
FIG. 1 shows schematically, in a view from above, a first embodiment of the installation according to the invention.

The installation shown in FIG. 1 comprises an air compression module or group 1, two air purification cylinders by adsorption 2A, 2B (drying-carbon dioxide removal) operating alternately, a "warm" module 3, a "cold" module 4, a double distillation column 5, and an assembly of straight connecting tubes 6.

Each of these above subassemblies is shown very schematically, but other constituents are known per se, and their connections as well as their corresponding operation are those customarily encountered in double column air distillation installations. These elements 1 to 6 will therefore be described only briefly.

Thus, the module 1 comprises, on a base 7, an electric motor 8 driving a principal compressor 9, and interstage coolers 10 of the compressor. The output of this latter leads to an inlet connector 11 of the module 1.

The cylinders 2A, 2B are conventional adsorption cylinders, each provided with two connections, respectively 12A, 12B.

The module 3 comprises a parallelepipedal framework 13 in which are fixed the assembly of the "warm" elements of the installation other than the compression module and the purification cylinders: the final cooler 14 of the compressor, connected to an inlet connection 15 disposed facing the connection 11, and a cold group 17 mounted in series with the cooler 14, a reheater 18 for gas for regenerating the adsorbent, the conduit 19 for evacuating the residual gas of the column, provided with a muffler 20, and also the assembly of the monitoring, control and instrumentation members relating to the elements 14 to 20, schematically shown at 21. The module 3 also comprises two connections 22A, 22B for each respective cylinder 2A, 2B, and couplings 23 for connection with the cold module 4, three in number in this example.

The module 4 comprises the principal heat exchange line 24, constituted by several parallelepipedal heat exchangers of the brazed plate type, a subcooler 25, the cold accessories of the installation such as cryogenic pumps 26 and turbines 27, and the assembly of the monitoring, control and instrumentation members relating to the elements 24 to 27, schematically shown at 28. The module 4 also comprises inlet/outlet connectors 29 of the heat exchange line, of a number equal to the couplings 23 and disposed facing these latter, and couplings 30 for connection to the column 5. The assembly of the elements 24 to 30 is mounted in a parallelepipedal framework 31. The assembly of the cold parts of the cold elements (exchangers 24 and 25, bodies of cryogenic valves, pumps 26, turbines 27, etc.) are thermally insulated, for example by means of perlite.

It will be understood that, according to the installation under consideration, the elements of the modules 3 and 4 can vary as to type and number. Moreover, these modules comprise all the connection conduits for their elements to each other, with corresponding automatic and/or remotely controlled valves.

The column 5 is a double column comprising a medium pressure column surmounted by a low pressure column, with a principal vaporizer-condenser which places in heat exchange relation the vapor (nitrogen) at the head of the medium pressure column and the liquid (oxygen) in the base of the low pressure column. This double column, whose height is considerably greater than that of the modules 3 and 4, is insulated under vacuum by a cylindrical wall 32 from which emerge connections 33 of a number equal to the connections 30 and disposed facing these latter.

The applicant has determined that even for installations of large size, for example producing tens of tons per day of oxygen, as well as of the type for the vaporization of liquid oxygen under pressure, it is possible to produce in the manner described above modules 3 and 4 of generally parallelepipedal shape whose external dimensions permit road transport.

Thus, at the site, it suffices to position the subassemblies 1, 2A, 2B, 3, 4 and 5, then to connect the corresponding couplings with straight tubes 6.

Figure 2:
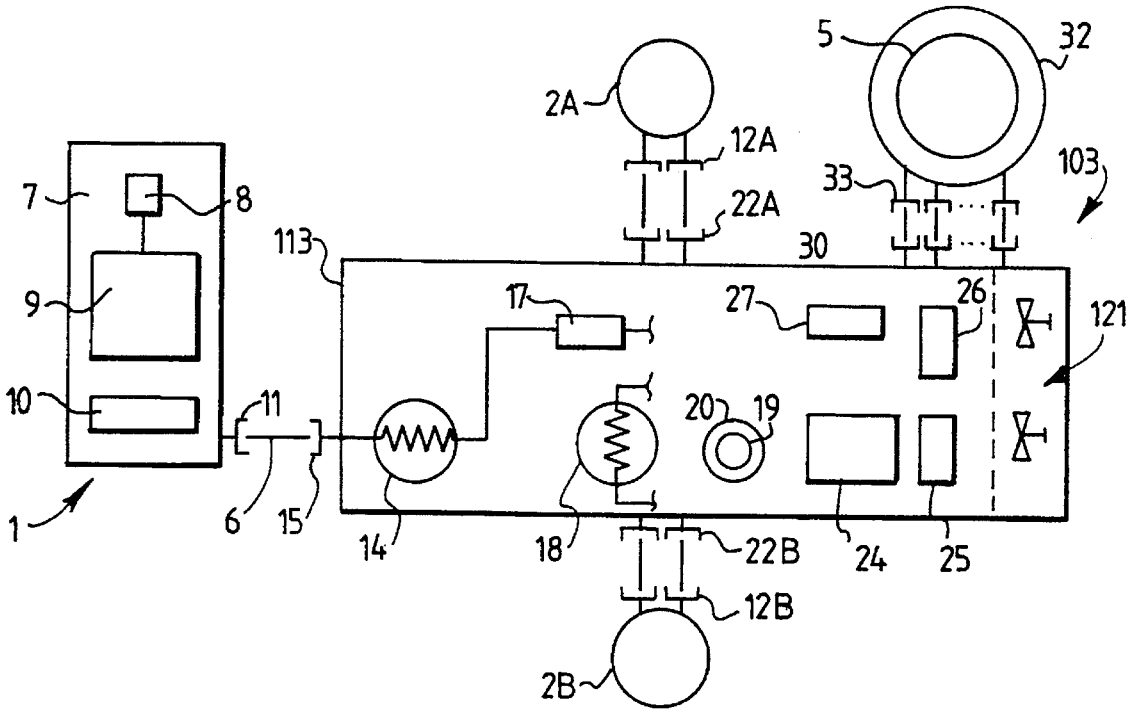
FIG. 2 is an analogous view, of a second embodiment of the installation according to the invention.

For installations of relatively moderate or small size, and/or of simplified design, it is also possible, as shown in FIG. 2, to connect the modules 3 and 4 in a single module 103 transportable by road, this module containing all the elements necessary for the operation of the installation, mounted in a parallelepipedal framework 113 provided with all the couplings 15, 22A, 22B and 30, the assembly of the monitoring, control and instrumentation members being assembled on one side of the module, at 121. This assembly at the site is then even more simple than in the case of FIG. 1.

Figure 3:
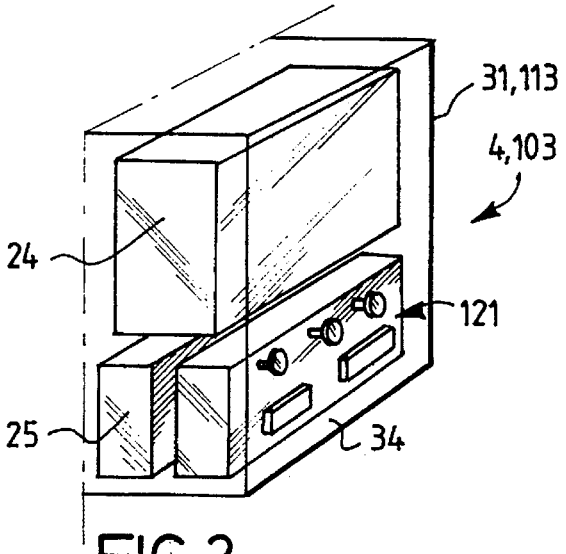
FIG. 3 shows schematically, in perspective, a portion of a preferred arrangement of a module of these installations.

As shown in FIG. 3, the or each module 3, 4 or 103 can comprise on one surface, in its lower portion, a compartment 34 very easily reached in which are grouped the assembly of the monitoring, control and instrumentation members 21, 28 or 121. In particular, in the cold module 4 or in the single module 103, shown in FIG. 3, the heat exchange line 24 can overlie in part the subcooler 25 and in part the compartment 34.

Moreover, in the installation of FIG. 1, there can be provided assemblies 21 and 28 in the compartments that are open and facing each other, and there can be provided between them, between the modules 3 and 4, a work station 35 having direct access to all the monitoring, control and instrumentation members of the installation.

Of course, the installation comprises also various conventional equipment associated with the electrical current supply, cooling water and as the case may be auxiliary gases, this equipment being connected to the corresponding components of the modules described above.

Furthermore, particularly in the case of installations of small size, it can be envisioned to mount the purification cylinders 2A, 2B in the single framework or in one at least of the two frameworks, and/or the compression group 1 in the single framework or in the "warm" framework.

What is claimed is:

1. Air distillation installation comprising:

(A) air compressor means having an output connected to an outlet coupling;

(B) two cylinders for the purification of air by adsorption having inlet/outlet couplings;

(C) a first framework in which are mounted: (a) means for precooling air; (b) valves and a regeneration gas reheater; and (c) connection conduits for (a) and (b), these conduits terminating in couplings for connection to other portions of the installation;

(D) a second framework in which are mounted: (d) heat exchangers and subcoolers; (e) cryogenic valves and a cryogenic pump and an expansion turbine; and (f) conduits for connecting (d) and (e) and (f) and terminating in couplings for connection to other portions of the installation;

(E) an air distillation column provided with a plurality of couplings for the inlet and outlet of fluids; and (F) tubes for connection between said couplings of (A) to (E).

2. Installation according to claim 1, wherein each framework contains an assembly of members in a lateral recess situated in its lower portion, the recesses of the two frameworks facing with each other and enclosing a work station for an operator.

3. Installation according to claim 1, wherein a tubing for venting to the air residual gas from the column is mounted in at least one of the two frameworks.

4. Installation according to claim 1, wherein all the connection tubes are straight.

5. Installation according to claim 1, wherein the column is insulated under vacuum.

6. Installation according to claim 1, wherein the column is a double air distillation column comprising a medium pressure column surmounted by a low pressure column.

7. Installation according to claim 1, wherein the purification cylinders are mounted in at least one of the two frameworks.

8. Installation according to claim 1, wherein the air compressor means is mounted in said first framework.

9. Installation according to claim 1, said tubes connecting said couplings of said first and second frameworks.

10. Air distillation installation, comprising:

(A) air compressor means having an output connected to an outlet coupling;

(B) two cylinders for the purification of air by adsorption having inlet/outlet couplings;

(C) an air distillation column provided with a plurality of couplings for the inlet and outlet of fluids;

(D) a framework in which are mounted elements of the installation other than said air distillation column, with connection conduits provided with couplings for the connection to other portions of the installation; and (E) tubes for connection between said couplings of (A) to (D).

11. Installation according to claim 10, wherein the framework contains an assembly of members in a lateral recess situated at its lower portion.

12. Installation according to claim 10, wherein a tubing for venting to the air residual gas from the column is mounted in the framework.

13. Installation according to claim 10, wherein the purification cylinders are mounted in the framework.

14. Installation according to claim 10, wherein the air compressor means is mounted in the framework.

15. Air distillation installation comprising six modules as follows:

(A) air compressor means having an output connected to an outlet coupling;

($B_1$) a first cylinder for the purification of air by adsorption having inlet and outlet couplings;

($B_2$) a second cylinder for the purification of air by adsorption having inlet and outlet couplings;

(C) a first framework in which are mounted (a) means for precooling air; (b) valves and a regeneration gas reheater; and (c) connection conduits for interconnecting (a) and (b), these conduits terminating in couplings for connection to other portions of the installation;

(D) a second framework in which are mounted (d) heat exchangers and subcoolers; (e) cryogenic valves and a cryogenic pump and an expansion turbine; and (f) conduits for connecting (d) and (e) and (f) and terminating in couplings for connection to other portions of the installation;

(E) an air distillation column provided with a plurality of couplings for the inlet and outlet of fluids;

there being tubes connecting between said couplings such that (A) is coupled to (C), ($B_1$) is coupled to (C), ($B_2$) is coupled to (C), (C) and (D) are coupled to each other, and (E) is coupled to (D).

16. Air distillation installation comprising five modules as follows:

(A) air compressor means having an output connected to an outlet coupling;

($B_1$) a first cylinder for the purification of air by adsorption having inlet and outlet couplings;

($B_2$) a second cylinder for the purification of air by adsorption having inlet and outlet couplings;

(C) a framework in which are mounted (a) means for precooling air; (b) valves and a regeneration gas reheater; and (c) connection conduits for interconnecting (a) and (b), these conduits terminating in couplings for connection to other portions of the installation; (d) heat exchangers and subcoolers; (e) cryogenic valves and a cryogenic pump and an expansion turbine; and (f) conduits for connecting (d) and (e) and (f) and terminating in couplings for connection to other portions of the installation;

(D) an air distillation column provided with a plurality of couplings for the inlet and outlet of fluids;

there being tubes connecting between said couplings such that (A) is coupled to (C), ($B_1$) is coupled to (C), ($B_2$) is coupled to (C), and (D) is coupled to (C).

* * * * *